US008803928B2

(12) United States Patent
Nagashima

(10) Patent No.: US 8,803,928 B2
(45) Date of Patent: Aug. 12, 2014

(54) IMAGE DISPLAY DEVICE, CONTROL METHOD THEREFOR, AND IMAGE DISPLAY SYSTEM

(75) Inventor: Yoshiyuki Nagashima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 211 days.

(21) Appl. No.: 13/414,191

(22) Filed: Mar. 7, 2012

(65) Prior Publication Data

US 2012/0236044 A1 Sep. 20, 2012

(30) Foreign Application Priority Data

Mar. 17, 2011 (JP) ..... 2011-059418
Jan. 24, 2012 (JP) ..... 2012-012079

(51) Int. Cl.
*G09G 5/10* (2006.01)

(52) U.S. Cl.
USPC ..... 345/690; 345/102

(58) Field of Classification Search
USPC ..... 345/690, 12, 63, 77, 89, 581–618, 102
See application file for complete search history.

(56) References Cited

U.S. PATENT DOCUMENTS

2013/0027438 A1* 1/2013 Hu et al. ..... 345/690

FOREIGN PATENT DOCUMENTS

| | | |
|---|---|---|
| JP | 2002-209230 | 7/2002 |
| JP | 2008-147889 | 6/2008 |

* cited by examiner

*Primary Examiner* — Kevin M Nguyen
*Assistant Examiner* — Kenneth B Lee, Jr.
(74) *Attorney, Agent, or Firm* — Cowan, Liebowitz & Latman, P.C.

(57) ABSTRACT

Included are a backlight having a plurality of light emitting blocks, a display panel, a calibration unit which carries out calibration of the display panel based on a result of measurement of the brightness and chromaticity of the display panel, a first measuring unit which measures individual temperatures of the plurality of light emitting blocks, a setting unit which sets a patch image display area in a region of the display panel corresponding to a light emitting block of which the magnitude of a change in temperature within a predetermined period of time is smaller than a threshold value, and a generation unit which generates a patch image to be displayed in the patch image display area, wherein the calibration unit carries out the calibration based on the result of measurement by the first measuring unit in cases where the patch image is displayed in the patch image display area.

20 Claims, 6 Drawing Sheets

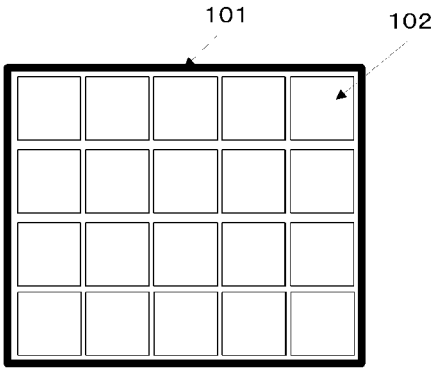
Fig.2A
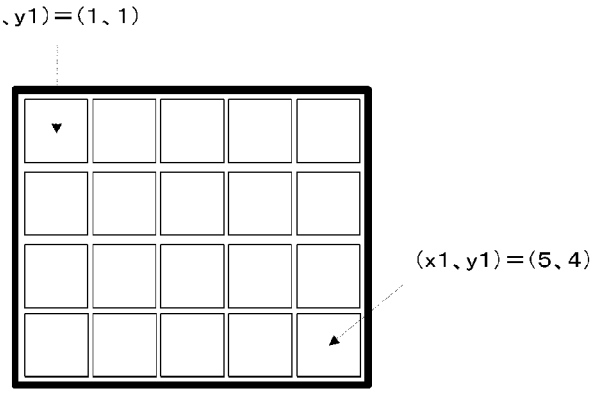
Fig.2B
| | | | | |
|---|---|---|---|---|
| 40 | 40 | 40 | 40 | 40 |
| 40 | 40 | 30 | 30 | 40 |
| 40 | 40 | 30 | 30 | 40 |
| 40 | 40 | 40 | 40 | 40 |
TEMPERATURE T(x1, y1)
Fig.2C
| | | | | |
|---|---|---|---|---|
| 1 | 1 | 1 | 1 | 1 |
| 1 | 1 | 0 | 0 | 1 |
| 1 | 1 | 0 | 0 | 1 |
| 1 | 1 | 1 | 1 | 1 |
FLAGS F1
Fig.2D
| | | | | |
|---|---|---|---|---|
| 1 | 1 | 1 | 1 | 1 |
| 1 | 1 | 0 | 0 | 1 |
| 1 | 1 | 0 | 0 | 1 |
| 1 | 1 | 1 | 1 | 1 |
FLAGS F2
Fig.2E
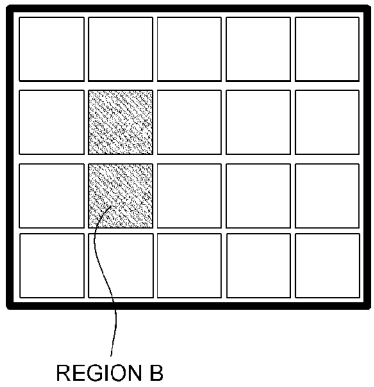
Fig.2F

IMAGE DISPLAY DEVICE, CONTROL METHOD THEREFOR, AND IMAGE DISPLAY SYSTEM

BACKGROUND OF THE INVENTION

1. Field of the Invention

The present invention relates to an image display device, a control method therefor, and an image display system.

2. Description of the Related Art

In recent years, in the progress of high definition of liquid crystal display devices, the level of user demand for the stability of display devices and the highly accurate color reproduction thereof also increases day by day. However, liquid crystal display devices will change in color reproducibility due to aged deterioration thereof. For that reason, in order for such liquid crystal display devices to achieve stable color reproducibility at all times, it is necessary to carry out calibration in a periodic manner.

In Japanese patent application laid-open No. 2002-209230, there is disclosed a processing method in which a patch for colorimetry or color measurement is displayed on a screen of an image display device, and adjustment of image quality is carried out by the measurement of the brightness and chromaticity of the patch by a user with the use of an optical sensor. Hereinafter, this processing method is referred to as calibration.

In addition, light emitting diodes (LEDs) have a long life span and are low in power consumption, so in recent years, they have been used as backlights for liquid crystal display devices. It is known that LEDs have their luminescence or emission properties changing in accordance with their temperature condition in which they are used. However, liquid crystal display devices are used under variety of environments, so there may be generated non-uniformity or irregularity in temperature for each of the LEDs (hereinafter referred to as temperature irregularity).

Moreover, in recent years, there is also known a control method which can obtain higher contrast by individually controlling the emission intensity for each LED according to an image signal inputted. (Hereinafter, this is referred to as local dimming.) Even in cases where local dimming is carried out, emission intensities of individual LEDs inside a backlight will vary according to the individual LEDs, and hence, temperature irregularity will similarly Occur.

When temperature irregularity occurs, the emission intensities of individual LEDs will vary for each LED due to the above-mentioned properties of the LEDs, as a result of which non-uniformity in brightness and chromaticity (hereinafter referred to as in-plane non-uniformity) will occur on a screen displayed on the liquid crystal display device. Thus, when calibration is carried out in a state where in-plane non-uniformity occurs in this manner, brightness and chromaticity will be different for each region in the screen, so it will be difficult to make adjustments with high accuracy.

In Japanese patent application laid-open No. 2008-147889, there is disclosed a processing method in which calibration can be carried out in a good manner even in cases where in-plane non-uniformity Occurs.

The processing method disclosed in Japanese patent application laid-open No. 2008-147889 is a method of measuring the in-plane non-uniformity of a display device, obtaining in-plane non-uniformity information, which is the result of the measurement, as well as information with respect to the position of display of a colorimetric or color measuring patch, and carrying out the adjustment of image quality by the use of both of these pieces of information.

SUMMARY OF THE INVENTION

However, in the method disclosed in Japanese patent application laid-open No. 2008-147889, it is necessary to measure a distribution of the in-plane non-uniformity each time calibration is carried out, as a result of which the time required for the calibration will increase.

In addition, if calibration is carried out in a state where temperature irregularity occurs inside the backlight, the luminescence properties of LEDs which are subjected to temperature irregularity will be changed during the execution of the calibration due to the temperature of those LEDs being not constant. As a result of this, the calibration can not be carried out with high or sufficient accuracy.

In other words, with the processing method disclosed in Japanese patent application laid-open No. 2008-147889, it is difficult to make adjustments with high or sufficient accuracy in cases where the characteristic of the in-plane non-uniformity is not constant during the execution of calibration.

Accordingly the present invention is intended to provide a technique in which calibration can be carried out with high or sufficient accuracy even in a state where temperature irregularity occurs in the inside of a backlight.

A first aspect of the present invention resides in an image display device comprising:

a backlight having a plurality of light emitting blocks;

a display panel that displays an image based on image data which is inputted thereto, by changing a transmissivity thereof for light irradiated from the backlight for each pixel in accordance with the inputted image data;

a calibration unit which carries out calibration of said display panel based on a result of measurement performed by a first measuring unit which measures the brightness and chromaticity of said display panel;

a second measuring unit which measures individual temperatures of said plurality of light emitting blocks;

a specifying unit which measures the individual temperatures of said plurality of light emitting blocks within a predetermined period of time by said second measuring unit, and specifies a light emitting block of which the magnitude of a change in temperature within the predetermined period of time is smaller than a threshold value;

a setting unit which sets a patch image display area for displaying a patch image for calibration in a region of the display panel corresponding to the light emitting block specified by said specifying unit; and a generation unit which generates the patch image to be displayed in the patch image display area set by said setting unit;

wherein said calibration unit carries out the calibration based on the result of the measurement by said first measuring unit in cases where the patch image generated by said generation unit is displayed in the patch image display area set by said setting unit.

A second aspect of the present invention resides in a control method for an image display device which includes a backlight having a plurality of light emitting blocks, and a display panel to display an image based on image data which is inputted thereto, by changing a transmissivity thereof for light irradiated from the backlight for each pixel in accordance with the inputted image data, said control method comprising:

a panel measured value obtaining step to obtain measured values of the brightness and chromaticity of said display panel;

a calibration step to carry out calibration of said display panel based on said obtained measured values;

a temperature obtaining step to obtain individual temperatures of said plurality of light emitting blocks;

a specifying step to specify a light emitting block of which the magnitude of a change in temperature within a predetermined period of time is smaller than a threshold value;

a setting step to set a patch image display area for displaying a patch image for calibration in a region of the display panel corresponding to said specified light emitting block; and a generation step to generate the patch image to be displayed in said set patch image display area;

wherein in said calibration step, the calibration is carried out based on the measured values obtained by said panel measured value obtaining step in cases where the patch image generated in said generation step is displayed in the patch image display area set in said setting step.

A third aspect of the present invention resides in an image display system comprising:

an image display device; and a calibration device to carry out calibration of the image display device;

wherein said image display device comprises:

a backlight having a plurality of light emitting blocks;

a display panel to display an image based on image data which is inputted thereto, by changing a transmissivity thereof for light irradiated from the backlight for each pixel in accordance with the inputted image data; and a second measuring unit which measures individual temperatures of said plurality of light emitting blocks;

wherein said calibration device comprises:

a first measuring unit which measures the brightness and chromaticity of said display panel;

a calibration unit which carries out calibration of said display panel based on a result of measurement performed by said first measuring unit;

a specifying unit which controls said second measuring unit so as to measure the individual temperatures of said plurality of light emitting blocks in a predetermined period of time, obtains a result of the measurement by said second measuring unit in the predetermined period of time, and specifies a light emitting block of which the magnitude of a change in temperature within the predetermined period of time is smaller than a threshold value;

a setting unit which sets a patch image display area for displaying a patch image for calibration in a region of the display panel corresponding to the light emitting block specified by said specifying unit; and a generation unit which generates the patch image to be displayed in the patch image display area set by said setting unit;

wherein said calibration unit carries out the calibration based on the result of the measurement by said first measuring unit in cases where the patch image generated by said generation unit is displayed in the patch image display area set by said setting unit.

According to the present invention, calibration can be carried out with high or sufficient accuracy even in a state where temperature irregularity occurs in a backlight.

Further features of the present invention will become apparent from the following description of exemplary embodiments with reference to the attached drawings.

BRIEF DESCRIPTION OF THE DRAWINGS

FIG. 2 is explanatory views of a backlight, a temperature distribution, and flags according to the image display device of FIG. 1.

DESCRIPTION OF THE EMBODIMENTS

First Embodiment

Hereinafter, preferred modes of embodiment of the present invention will be described by using the accompanying drawings.

Figure 1A:
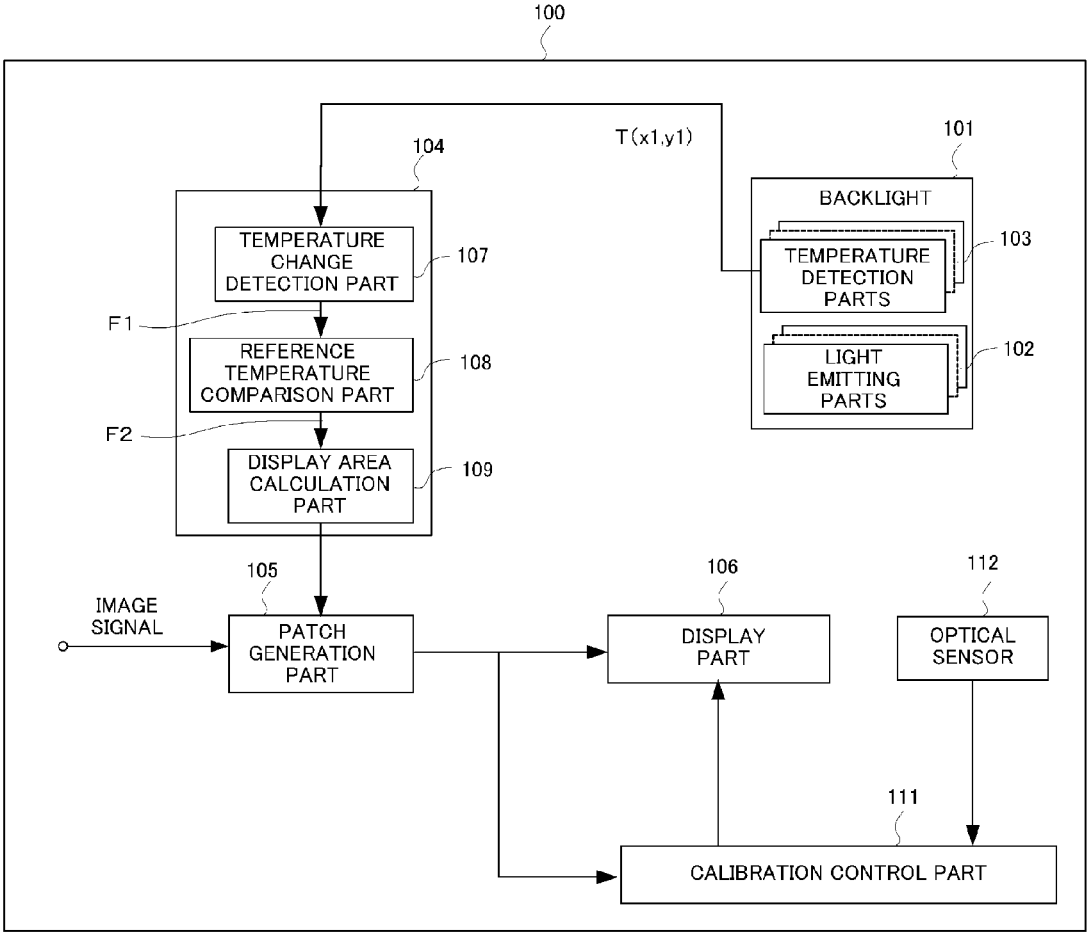
FIG. 1 is a block diagram of an image display device and a construction view of a light emitting part according to a first embodiment of the present invention.

FIG. 1A is a block diagram of an image display device to which the present invention can be applied.

The image display device 100 shown in FIG. 1A has a backlight 101, a plurality of light emitting parts 102 (light emitting blocks) arranged in the inside of the backlight 101, and a display part 106 (display panel). The display part 106 is composed of a liquid crystal panel which changes its transmissivity for light irradiated or emitted from the backlight 101 for each pixel in accordance with image data to be inputted, and it serves to display an image based on the image data. The image display device 100 has a patch generation part 105 that generates a patch image for calibration, and an optical sensor 112 that measures the brightness and chromaticity of a predetermined area to be measured of the display part 106. The image display device 100 also has a calibration control part 111. The calibration control part 111 obtains the result of the measurement (measured values) performed by the optical sensor 112, and carries out calibration of the display part 106 based on the measurement result. The image display device 100 has a plurality of temperature detection parts 103 that measure the temperatures of the plurality of the light emitting parts 102, respectively, and a display area specifying part 104 that specifies an area in which the patch image for calibration is displayed, from the result of detection of the temperature detection parts 103. The calibration control part 111 carries out the calibration based on the result of the measurement by the optical sensor 112 in cases where the patch image for colorimetry or color measurement generated by the patch generation part 105 is displayed in the display area specified by the display area specifying part 104.

The backlight 101 shown in FIG. 1A has the light emitting parts 102 arranged in plurality, as shown in FIG. 2A, and in this mode of embodiment, it is constructed such that a total of 20 light emitting parts 102 are arranged in a 5×4 array.

Although this embodiment has a construction including the total number of 20 light emitting parts 102, the value of the total number is arbitrary, and an appropriate number of them should just be arranged according to the use thereof.

In this embodiment, the position of each of the light emitting parts 102 is represented by a combination (x1, y1) of the position x1 in the horizontal direction counted from the upper left corner, and the position y1 in the longitudinal or vertical direction counted from the upper left corner, as shown in FIG. 2B. In the construction of this embodiment, (x1, y1) take values of (1, 1)-(5, 4). A light emitting part 102 corresponding to a region (x1, y1) is represented as a light emitting part 102 (x1, y1).

Figure 1B:
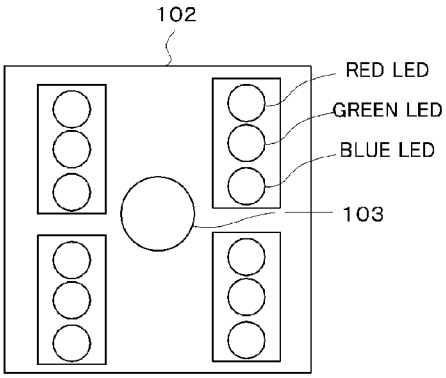

As shown in FIG. 1B, it is constructed such that four sets of LEDs are arranged in each of the light emitting parts 102 shown in FIG. 1A, each set including LEDs of three colors of red, green and blue, and a related one of the temperature detection parts 103 is arranged in the central portion of each of the light emitting parts 102.

The temperature detection parts 103 are sensors which can detect the temperatures of the light emitting parts 102, respectively.

In addition, the display part 106 shown in FIG. 1A is assumed to be a liquid crystal panel of 1920×1080 dots. The number of pixels of the liquid crystal panel is not limited to this.

Reference will be made to the operation of this embodiment constructed as described above by the use of an image shown in FIG. 2C.

FIG. 2C shows a temperature distribution in the individual light emitting parts 102 (x1, y1) inside the backlight 101, and numerical characters in this figure show the temperatures of the individual light emitting parts 102 (x1, y1), respectively. In this example, the temperatures of the light emitting part 102 (3, 2), the light emitting part 102 (4, 2), the light emitting part 102 (3, 3) and the light emitting part 102 (4, 3) (hatched regions in this figure) are 30 degrees C., and the temperatures of the other light emitting parts 102 (x1, y1) are 40 degrees C., so a temperature distribution (temperature irregularity) is generated.

In this embodiment, temperatures T corresponding to the light emitting parts 102 (x1, y1) are denoted by T (x1, y1).

In this embodiment, a processing method will be described in the case of carrying out the calibration in a state where the temperature distribution shown in FIG. 2C occurs.

When the calibration control part 111 carries out calibration processing, the temperature detection parts 103 shown in FIG. 1A detect the individual temperatures of the light emitting parts 102 (x1, y1), and transmit the temperatures T (x1, y1) corresponding to the individual light emitting parts 102 (x1, y1) to the display area specifying part 104. Here, a case where the detected values of the temperatures shown in FIG. 2C are transmitted as the temperatures T (x1, y1) will be described by way of example.

The display area specifying part 104 decides a display area of a colorimetric or color measuring patch to be used for calibration based on the temperatures T (x1, y1) of the individual light emitting parts 102 (x1, y1) thus transmitted.

The display area specifying part 104 is composed of a temperature change detection part 107, a reference temperature comparison part 108 and a display area calculation part 109, as shown in FIG. 1A.

The temperature change detection part 107 shown in FIG. 1A detects a change in temperature of each light emitting part in the time direction from the results of temperature detection T (x1, y1) carried out by the temperature detection parts 103. Then, in cases where the temperature is constant, a flag F1 is set to 1 (F1=1), whereas in cases where the temperature is not constant, the flag F1 is set to (F1=0), and these determination results are transmitted to the reference temperature comparison part 108.

The temperature change detection part 107 detects the changes in temperature of the light emitting parts 102 (x1, y1) in the time direction by obtaining the individual temperatures of the light emitting parts 102 (x1, y1) measured by the temperature detection parts 103, respectively, over a predetermined period of time (temperature obtaining processing). The temperature change detection part 107 detects the temperature changes by obtaining the amounts of temperature changes (the magnitudes of the temperature changes) within the predetermined period of time based on the temperatures thus obtained, and making a comparison between each of the amounts of temperature changes and a threshold value Th1. The temperature change detection part 107 outputs the flags F1 of the light emitting parts 102 (x1, y1) by setting them in the following manner. That is, the flags F1 of the light emitting parts 102 (x1, y1) of which the amounts of temperature changes are smaller than the threshold value Th1 are set to 1 (F1=1), and the flags F1 of the light emitting parts 102 (x1, y1) of which the amounts of temperature changes are equal to or larger than the threshold value Th1 are set to 0 (F1=0).

In this embodiment, the flags F1 shown in FIG. 2D are to be transmitted to the reference temperature comparison part 108. In the example of FIG. 2D, the flags F1 of the regions (3, 2), (4, 2), (3, 3) and (4, 3) are set to 0 (F1=0), and the flags F1 of the other regions are set to 1 (F1=1). In other words, in this example, it is assumed that the temperatures of the regions shown by hatching in FIG. 2D are not constant, and the temperatures of the other regions are constant. The temperature change detection part 107 carries out processing to specify those light emitting parts 102 (x1, y1) of which the amounts of temperature changes within the predetermined period of time are smaller than the threshold value Th1.

The reference temperature comparison part 108 shown in FIG. 1A compares the temperatures T (x1, y1) of the individual light emitting parts 102 (x1, y1) with a reference temperature Ts which is a temperature suitable for calibration. The reference temperature Ts may be set in each of the light emitting parts 102 (x1, y1), or may be set for each emission intensity of the backlight.

In this embodiment, in order to simplify the description, the reference temperature Ts is assumed to be a value irrespective of the emission intensities of the light emitting parts 102 (x1, y1) or the emission intensity of the backlight. In this embodiment, the reference temperature comparison part 108 makes a determination that in cases where the temperature T is within a range between 38 degree C. and 42 degree C. (38 degree C.□T□42 degree C.), a difference between the temperature T and the reference temperature Ts is smaller than a threshold value Th2, i.e., the temperature T is coincident with the reference temperature Ts.

In the regions of which the flags are 1 (F1=1), the reference temperature comparison part 108 shown in FIG. 1A compares each of the temperatures T (x1, y1) with the reference temperature Ts in a sequential manner.

In cases where the difference between each of the temperatures T (x1, y1) and the reference temperature Ts is smaller than threshold value Th2, the reference temperature comparison part 108 sets the flags F2 of the regions (x1, y1) to 1 (F2=1). On the other hand, in cases where the difference between each of the temperatures T (x1, y1) and the reference temperature Ts is equal to or more than the threshold value Th2, the reference temperature comparison part 108 sets the flags F2 of the regions (x1, y1) to 0 (F2=0). The reference temperature comparison part 108 transmits these determination results to the display area calculation part 109. In other words, those regions of which the flags F2 are 1 (F2=1) are regions in which the temperatures are constant and the temperatures are coincident with the reference temperature Ts. In this embodiment, the regions of which the flags F2 are 1 (F2=1) are referred to as a region A.

In the case of this embodiment, the flags F2 shown in FIG. 2E are transmitted to the display area calculation part 109. In this example, the flags F2 of the regions (3, 2), (4, 2), (3, 3) and (4, 3) are set to 0 (F2=0). The flags F2 of the other regions are set to 1 (F2=1), and these regions are specified as the region A (hatched regions shown in FIG. 2E).

The display area calculation part 109 shown in FIG. 1A decides a region B in which the patch is to be displayed, from the region A corresponding to its flags F2 which are 1 (F2=1). It is common to adjust the calibration in the central portion of a screen, and hence, in this embodiment, the display area calculation part 109 sets, as the region B, those regions among the region A which are located in positions close to the central portion of the screen. However, it is arbitrary to specify or set which ones of the region A are specified as the region B, so such a setting should just be made according to the use thereof. In this embodiment, the display area calculation part 109 decides, among the region A, the regions (2, 2) and (2, 3) close to the central portion of the screen as the region B. The region B thus decided is shown by hatching in FIG. 2F. The size of the region B should just be larger than a minimum size of the patch to be displayed. If the size of the patch to be displayed is too small, colorimetry or color measurement can not be carried out, so the size of the patch to be displayed is made equal to or more than a size which has been beforehand set.

Next, the display area calculation part 109 calculates, based on the position of the region B, the coordinates of that region in the display part 106 in which the patch is displayed.

Figure 3A:
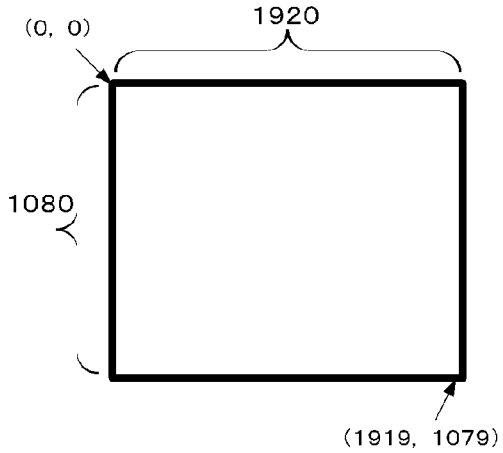
FIG. 3 is explanatory views of a display part of the image display device of FIG. 1.

In this embodiment, the display part 106 is a liquid crystal panel having 1920×1080 dots, as shown in FIG. 3A, and the coordinates of the display area thereof are represented by a combination of the coordinates of a pixel on the uppermost leftmost corner of the display area, and the coordinates of a pixel in the lowermost rightmost corner of the display area, as shown in this figure. The coordinates of pixels in the display area take the values of (0, 0)-(1919, 1079).

The display area calculation part 109 calculates the coordinates (x2_0, y2_0) and (x2_1, y2_1) of a region C in the display part 106 corresponding to the region B thus decided. The calculation of the coordinates of the region C corresponding to the region B should just be carried out by referring to table data in which the regions (x1, y1) of the individual light emitting parts 102 are associated with the coordinates in the display part 106 corresponding to these regions, and which has been beforehand stored in a storage unit or the like which is not shown.

Figure 3B:
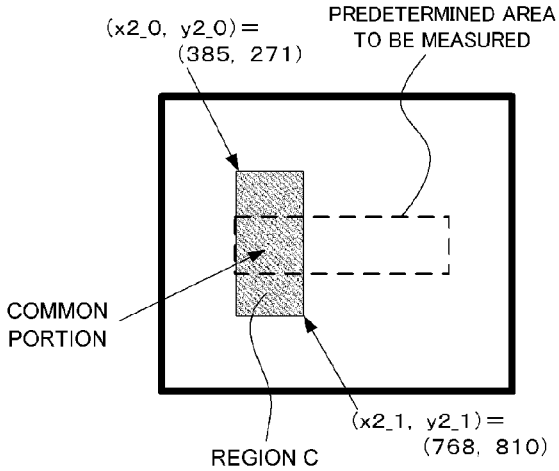

In this embodiment, because the region B is formed of the regions (2, 2) and (2, 3), the coordinates of the region C corresponding to the region B are calculated as (x2_0, y2_0) =(385, 271) and (x2_1, y2_1)=(768, 810), respectively, as shown in FIG. 3B.

Because the calibration is generally adjusted in the central portion of the screen, the display area calculation part 109 decides a region, which is located within the range of the region C in a position close to the central portion of the screen, as the display area of the colorimetric patch (patch image display area). Here, the reason for deciding the position close to the central portion of the screen as the patch image display area is that an area to be measured by the optical sensor 112 (a region denoted by a broken line in FIG. 3B) exists in the central portion of the screen. That is, the display area calculation part 109 sets the display area of the colorimetric patch in a region which is contained in both the region C and the area to be measured. In this embodiment, the display area of the colorimetric patch thus decided within the range of a common portion between the region C and the area to be measured, as shown in FIG. 3B, is referred to as a region D. The display area calculation part 109 calculates the coordinates (x3_0, y3_0) and (x3_1, y3_1) of the region D based on the coordinates (x2_0, y2_0) and (x2_1, y2_1) of the region C.

The calculation of the coordinates of the region D is carried out as follows. Table data, which serves to make an association between the coordinates (x2_0, y2_0) and (x2_1, y2_1) of the region C and the coordinates (x3_0, y3_0) and (x3_1, y3_1) of the display area of the colorimetric patch D, has been beforehand stored in an unillustrated storage unit or the like. Then, the coordinates of the region D are calculated by referring to this table data.

Figure 3C:
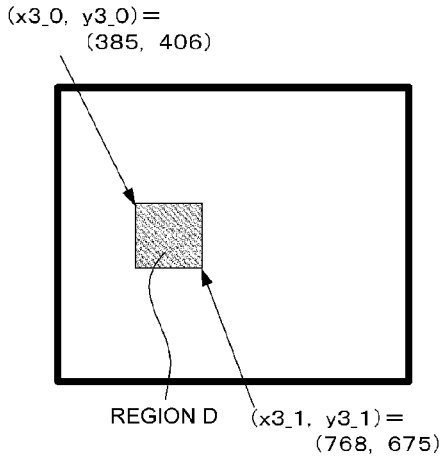

In this embodiment, it is assumed that (x3_0, y3_0)= (385, 406) and (x3_1, y3_1)=(768, 675) are calculated as the coordinates of the region D. The region D in the display part 106 thus decided is shown by hatching in FIG. 3C.

The patch generation part 105 generates the colorimetric patch to be displayed in the region D, and outputs it to the display part 106. As a result of this, the colorimetric patch is displayed in the region D of the display part 106. The region D is a region in which the temperature of a corresponding light emitting part 102 is coincident with a temperature suitable for calibration and is constant within the predetermined period of time. After that, the calibration control part 111 carries out the calibration of the display part 106 by obtaining, from the optical sensor 112, the measured values of the brightness and chromaticity of the region D in which the patch has been displayed (panel measured value obtaining processing), and making a comparison of the measured values thus obtained with the colorimetric patch.

The temperature of the light emitting part 102 corresponding to the region D is considered to be constant during the execution of the calibration, because it has been constant within the predetermined period of time. Therefore, it is possible to suppress the luminescence properties of LEDs from changing during the execution of the calibration, thus making it possible to carry out the calibration with high or sufficient accuracy.

Here, note that the region to be set as the region D should just be set arbitrarily within the range of the region C with a size and position that does not have trouble in measurement by the optical sensor.

In addition, the size of the patch to be displayed may be changed according to the area of a region in which the temperature is constant. In other words, in cases where the region in which the temperature is constant is small in area, the size of the patch to be displayed may be made accordingly small, whereas in cases where the region in which the temperature is constant is large in area, the size of the patch to be displayed may be made accordingly large.

In addition, although in this embodiment, the construction having both the temperature change detection part 107 and the reference temperature comparison part 108 has been shown as an example, the construction may be such that only either one of the temperature change detection part 107 and the reference temperature comparison part 108 may be provided. For example, in cases where only the temperature change detection part 107 is provided, it is preferable to set the threshold value Th1 used for the comparison with the amounts of temperature changes to a smaller value. In cases where the amounts of temperature changes are sufficiently small, it is considered that in many cases, the temperatures detected are close to the reference temperature. Moreover, in cases where only the reference temperature comparison part 108 is provided, it is preferable to set the threshold value Th2 used for the comparison with the reference temperature Ts to a smaller value. In cases where the temperatures detected are sufficiently close to the reference temperature, it is considered that in many cases, the amounts of temperature changes are small.

Further, although in this embodiment, reference has been made to an example in which the display area of the colorimetric patch is set within a region which is included in both the region C and the area to be measured, the display area of the colorimetric patch may be set within a region included in the region C. In other words, the area to be measured may be set as the entire screen.

Although in this embodiment, the description has been made by the use of an example in which temperature irregularity occurs inside the backlight under the influence of the use or operating environment of the display device, the present invention can be similarly applied to a case where temperature irregularity occurs inside the backlight due to local dimming, too.

In addition, although in this embodiment, the image display device with a backlight construction using LEDs of three colors, i.e., red, green and blue, has been described as an example, the present invention can also be applied to an image display device with a backlight construction using LEDs of white color instead of LEDs of the three colors.

Figure 4:
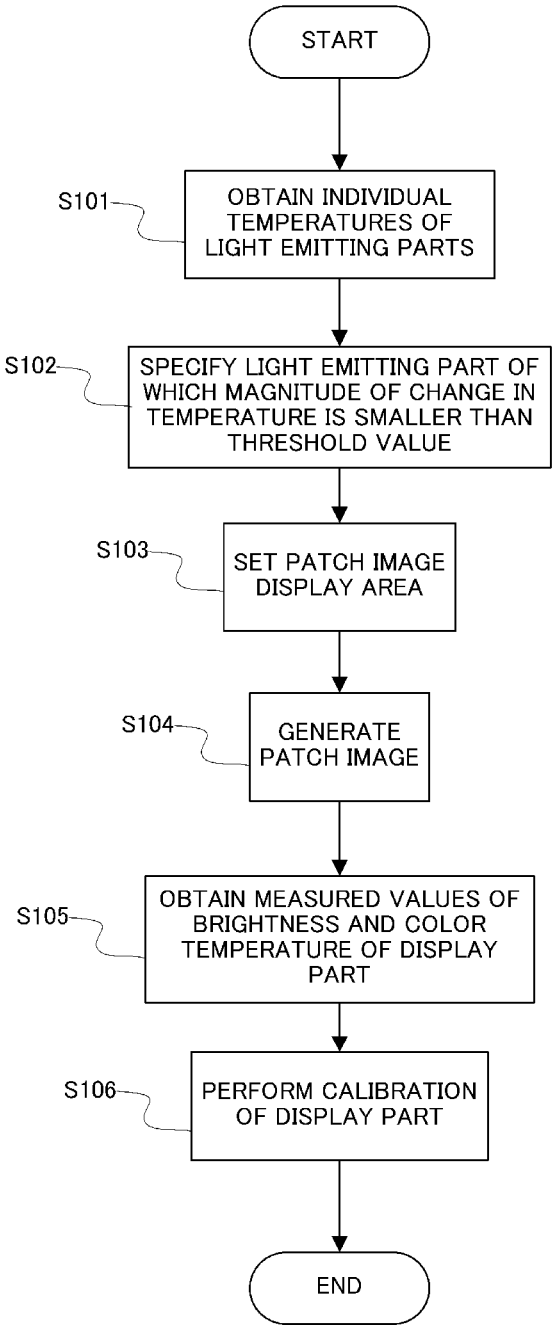
FIG. 4 is a flow chart showing calibration processing.

Here, reference will be made to an example of the procedure of the execution of the calibration processing according to the image display device of this embodiment. FIG. 4 is a flow chart showing the calibration processing.

In step S101, the temperature detection parts 103 obtain the temperatures of the individual light emitting parts 102 of the backlight 101, respectively.

In step S102, the temperature change detection part 107 of the display area specifying part 104 specifies those light emitting blocks of which the magnitudes of the individual temperature changes of the plurality of the light emitting parts 102 within the predetermined period of time are smaller than the threshold value Th1.

In step S103, the display area calculation part 109 of the display area specifying part 104 sets a patch image display area for displaying a patch image for calibration within a region of the display part 106 corresponding to the light emitting blocks 102 thus specified in step S102.

In step S104, the patch generation part 105 generates a patch image to be displayed in the patch image display area set in step S103.

In step S105, the optical sensor 112 obtains the measured values of the brightness and chromaticity of the display part 106.

In step S106, the calibration control part 111 carries out the calibration of the display part 106 based on the measured values obtained by the optical sensor 112 in step S105.

According to the image display device of the present invention, calibration can be carried out with high or sufficient accuracy even in cases where temperature irregularity occurs in the inside of the backlight.

Second Embodiment

Hereinafter, a second mode of embodiment of the present invention will be described by the use of the drawings.

In the first embodiment, it has been described that the colorimetric patch to be used in calibration is displayed in a region of the display part corresponding to those regions of the light emitting parts in which the temperatures of LEDs are constant and within the range of the reference temperature. In the second embodiment, during the period of the execution of the calibration using the method of the first embodiment, the emission intensities of LEDs for those light emitting parts of which the temperatures have been determined not to be constant are adjusted in such a manner that the temperatures of those light emitting parts becomes constant.

Figure 5:
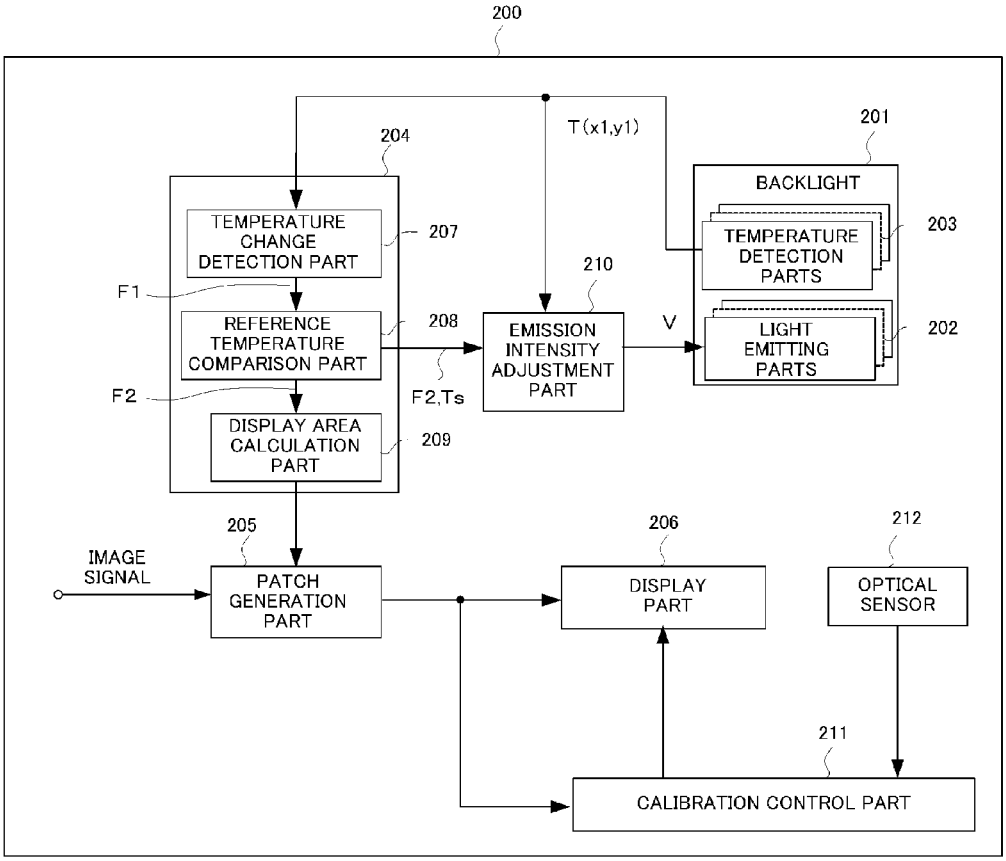
FIG. 5 is a block diagram of an image display device according to a second embodiment of the present invention.

FIG. 5 is a block diagram of an image display device to which the present invention can be applied. FIG. 5 is different in comparison with FIG. 1A of the first embodiment in that an emission intensity adjustment part 210 is added.

The emission intensity adjustment part 210 specifies, from a result of comparison F2 made by a reference temperature comparison part 208, those light emitting parts 202 (x1, y1) which have been determined as F2=0, as shown in FIG. 5. That is, the emission intensity adjustment part 210 specifies those light emitting parts 202 (x1, y1) in which the magnitudes of the temperature changes within a predetermined period of time are equal to or more than a threshold value, or in which a difference between each of the measured temperatures and the reference temperature Ts is equal to or more than a threshold value. A temperature change detection part 207, which carries out processing to specify those light emitting parts 202 (x1, y1) of which the flags F2 are 0 (F2=0), and the reference temperature comparison part 208 serve to function as second identification unit in the present invention.

The emission intensity adjustment part 210 adjusts the emission intensities of LEDs in such a manner that the difference between each of the temperatures T (x1, y1) of the above-mentioned individual light emitting parts thus specified and the reference temperature Ts becomes small, and outputs them to the individual light emitting parts 202 (x1, y1) as emission intensities V, respectively. The emission intensities V are parameters for setting the emission intensities of the individual light emitting parts 202 (x1, y1).

In cases where the temperature distribution inside the backlight is as shown by the temperature distribution in FIG. 2C, the flags F2 shown in FIG. 2E as described in the first embodiment are outputted from the reference temperature comparison part 208. The emission intensity adjustment part 210 specifies those light emitting parts 202 (x1, y1) which correspond to flag F2=0 (i.e., their flags F2 are 0), and outputs them as light emitting parts 202_0. In the example shown in FIG. 2E, the light emitting parts 202 (x1, y1) specified as the light emitting parts 202_0 are light emitting parts 202 (3, 2), (4, 2), (3, 3) and (4, 3) other than those light emitting parts which are shown by hatching. In addition, in the following, those light emitting parts 202 (x1, y1) which correspond to flag F2=1 are denoted as light emitting parts 202_1.

Next, the emission intensity adjustment part 210 adjusts the emission intensities of the light emitting parts 202_0.

Figure 6A:
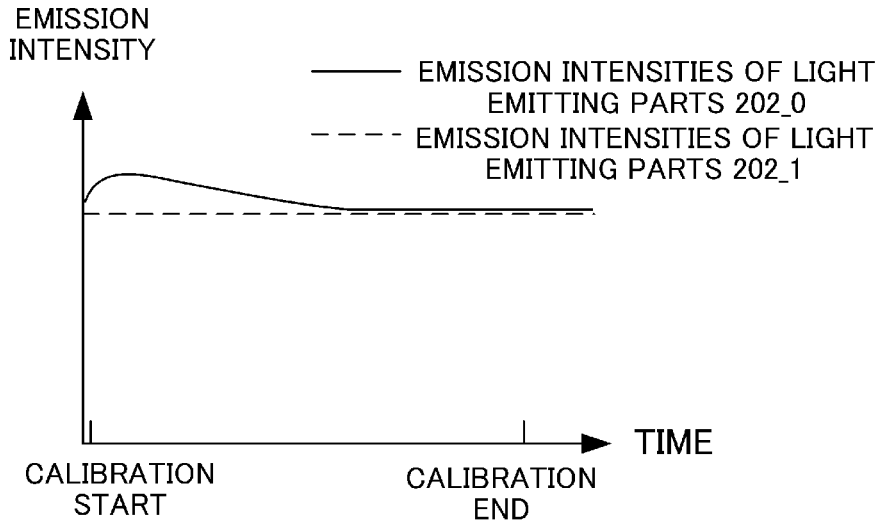
FIG. 6 is explanatory views of a method for adjusting the intensity of light emission described in the second embodiment.

In cases where the temperatures of the light emitting parts 202_0 are lower than the reference temperature Ts, the emission intensity adjustment part 210 makes, as shown in FIG. 6A, the emission intensities of the light emitting parts 202_0 (a solid line in this figure) brighter than the emission intensities of the light emitting parts 202_1 (a dotted line in this figure). After that, the emission intensity adjustment part 210 carries out an adjustment to decrease the emission intensities of the light emitting parts 202_0 so that the temperatures of the light emitting parts 202_0 become coincident with the reference temperature Ts.

Figure 6B:
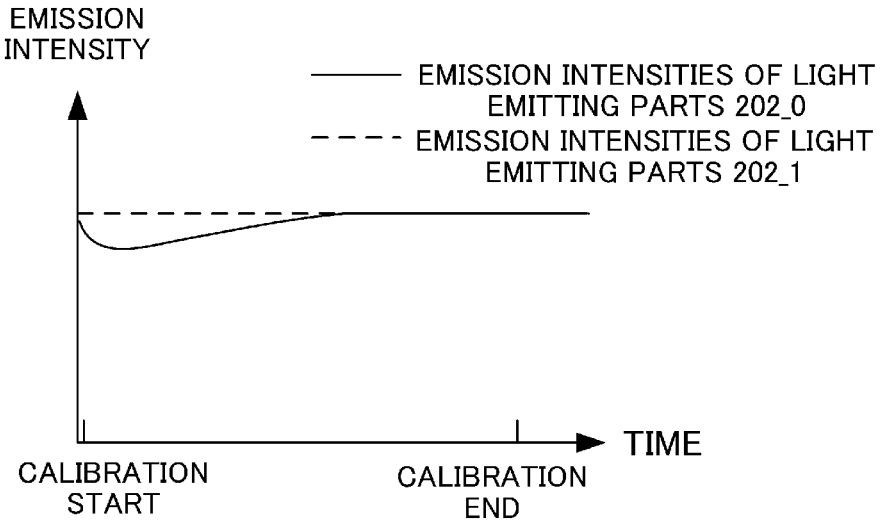

In cases where the temperatures of the light emitting parts 202_0 are higher than the reference temperature Ts, the emission intensity adjustment part 210 makes, as shown in FIG. 6B, the emission intensities of the light emitting parts 202_0 (a solid line in this figure) darker than the emission intensities of the light emitting parts 202_1 (a dotted line in this figure). After that, the emission intensity adjustment part 210 carries out an adjustment to increase the emission intensities of the light emitting parts 202_0 so that the temperatures of the light emitting parts 202_0 become coincident with the reference temperature Ts.

According to the above-mentioned processing, at the time of the execution of the calibration, the temperatures of those light emitting parts 202 of which the temperatures are not constant or are not coincident with the reference temperature Ts can be made coincident with the reference temperature Ts. That is, the temperatures of the light emitting parts can be adjusted in a uniform manner, so in-plane non-uniformity or unevenness can be eliminated.

In this embodiment, reference has been made to an example in which the emission intensities of the individual light emitting parts 202 are adjusted by the use of the detected values of the temperatures thereof so that the temperatures thereof become constant. Besides this, a brightness sensor(s) may be arranged in the inside of the backlight, and the emission intensities may be adjusted by the use of the detected value(s) of the brightness sensor(s).

According to the image display device of this embodiment, after termination (or end) of the calibration, it is possible to obtain a desired optical property, and it is still possible to put the device into a state where in-plane non-uniformity is also eliminated.

In the foregoing, some modes for carrying out the present invention have been described in detail by the use of embodiments, but practical modes of the present invention are not limited only to the above-mentioned embodiments.

For example, in the above-mentioned respective embodiments, there have been shown construction examples in which an image display device is provided with a calibration control part that carries out calibration, but a construction is also possible in which calibration is carried out by means of a calibration device which is provided separately from an image display device. For example, software for calibration is installed on a personal computer (PC) which is connected to an image display device, or a function expansion unit which carries out calibration is connected to an image display device. Then, an optical sensor transmits the result of its measurement to the PC. The image display device transmits the results of measurements by temperature detection parts to the PC. Based on the detection results of the temperatures of the individual light emitting parts received from the temperature detection parts of the image display device, the PC determines the temperature changes of the individual light emitting parts and the coincidence of the temperatures thereof with a reference temperature, and decides a patch image display area. That is, the PC may carry out the processing of the display area specifying part 104 in the above-mentioned embodiments. The PC generates a patch image to be displayed in the patch image display area thus decided, and outputs it to the image display device. That is, the PC may carry out the processing of the patch generation part 105 in the above-mentioned embodiments. In this case, the PC may transmit information on flags F2 to the image display device, and the image display device may adjust, based on the information on the flags F2 received from the PC, the emission intensities of the individual light emitting parts by means of the emission intensity adjustment part 210. In this case, the image display device and the PC together constitute an image display system of the present invention.

The present invention can be applied both in cases where the individual blocks of the image display device are implemented by hardware, and in cases where they are implemented by software processing using a computer, while making it possible to obtain the same effects. In this case, the program code of the above-mentioned software itself will achieve the functions of the above-mentioned modes of embodiment. Then, the program code itself and means for supplying its program code to the computer, e.g., a storage medium in which such a program code is stored, together constitute the present invention. As a storage medium which stores such a program code, there can be used a hard disk, an optical disk, a magneto-optical disc, a CD-ROM, a magnetic tape, a nonvolatile memory card, a ROM, and so on.

In addition, in cases where the functions described in the above-mentioned modes of embodiment are achieved by the computer executing the program code supplied thereto, such a program code is included as an embodiment mode of the present invention. Moreover, also in cases where the functions shown in the above-mentioned embodiment modes are achieved by cooperation of an OS (operating system) or other application software etc. with which the program code works in the computer jointly is achieved, this program code is included in an embodiment mode of the present invention.

Further, the present invention also includes a case where the functions of the above-mentioned modes of embodiment are achieved by the following processing. That is, the program code supplied is stored in a memory which is provided in a function expansion board of a computer, or which is provided in a function expansion unit connected to a computer. Thereafter, a CPU, etc., which is provided in the function expansion board or the function expansion unit, carries out part or all of actual processing based on instructions of the program code.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-059418, filed on Mar. 17, 2011, and Japanese Patent Application No. 2012-012079, filed on Jan. 24, 2012, which are hereby incorporated by reference herein in their entirety.

What is claimed is:

1. An image display device comprising:

a backlight having a plurality of light emitting blocks;

a display panel to display an image based on image data which is inputted thereto, by changing a transmissivity thereof for light irradiated from the backlight for each pixel in accordance with the inputted image data;

a calibration unit which carries out calibration of said display panel based on a result of measurement performed by a first measuring unit which measures the brightness and chromaticity of said display panel;

a second measuring unit which measures individual temperature values of said plurality of light emitting blocks;

a specifying unit which controls said second measuring unit so as to measure the individual temperature values of said plurality of light emitting blocks within a predetermined period of time, and specifies a light emitting block of which the magnitude of a change in temperature within the predetermined period of time is smaller than a threshold value;

a setting unit which sets a patch image display area for displaying a patch image for calibration in a region of the display panel corresponding to the light emitting block specified by said specifying unit; and a generation unit which generates the patch image to be displayed in the patch image display area set by said setting unit;

wherein said calibration unit carries out the calibration based on the result of the measurement by said first measuring unit in a case where the patch image generated by said generation unit is displayed in the patch image display area set by said setting unit.

2. The image display apparatus as set forth in claim 1, wherein said specifying unit specifies a light emitting block of which the magnitude of a change in temperature within the predetermined period of time is smaller than the threshold value, and a difference between a temperature measured by said second measuring unit and a predetermined reference temperature is smaller than a threshold value.

3. The image display apparatus as set forth in claim 1, wherein said setting unit sets the patch image display area for displaying the patch image for calibration in a region which is included in both of the region of the display panel corresponding to the light emitting block specified by said specifying unit, and a region within an area which is predetermined to be measured by said first measuring unit.

4. The image display apparatus asset forth in claim 1, wherein said setting unit sets the patch image display area in a predetermined area close to a central portion of the display panel.

5. The image display apparatus asset forth in claim 1, wherein said generation unit adjusts the size of the patch image to be generated according to the size of the patch image display area set by said setting unit.

6. The image display apparatus as set forth in claim 1, further comprising:

an emission intensity adjustment unit which adjusts individual emission intensities of said plurality of light emitting blocks; and a second specifying unit which specifies a light emitting block of which the magnitude of a change in temperature within the predetermined period of time is equal to or more than the threshold value, or a difference between a temperature measured by said second measuring unit and a reference temperature is equal to or more than a threshold value;

wherein at the time of the execution of the calibration by said calibration unit, said emission intensity adjustment unit adjusts the emission intensity of the light emitting block specified by said second specifying unit so that a difference between the temperature of that light emitting block and the reference temperature becomes small.

7. A control method for an image display device which includes a backlight having a plurality of light emitting blocks, and a display panel to display an image based on image data which is inputted thereto, by changing a transmissivity thereof for light irradiated from the backlight for each pixel in accordance with the inputted image data, said control method comprising:

a panel measured value obtaining step to obtain measured values of the brightness and chromaticity of said display panel;

a calibration step to carry out calibration of said display panel based on said obtained measured values;

a temperature obtaining step to obtain individual temperature values of said plurality of light emitting blocks;

a specifying step to specify a light emitting block of which the magnitude of a change in temperature within a predetermined period of time is smaller than a threshold value;

a setting step to set a patch image display area for displaying a patch image for calibration in a region of the display panel corresponding to said specified light emitting block; and a generation step to generate the patch image to be displayed in said set patch image display area;

wherein in said calibration step, the calibration is carried out based on the measured values obtained by said panel measured value obtaining step in a case where the patch image generated in said generation step is displayed in the patch image display area set in said setting step.

8. An image display system comprising:

an image display device; and a calibration device to carry out calibration of the image display device;

wherein said image display device comprises:

a backlight having a plurality of light emitting blocks;

a display panel to display an image based on image data which is inputted thereto, by changing a transmissivity thereof for light irradiated from the backlight for each pixel in accordance with the inputted image data; and a second measuring unit which measures individual temperature values of said plurality of light emitting blocks;

wherein said calibration device comprises:

a first measuring unit which measures the brightness and chromaticity of said display panel;

a calibration unit which carries out calibration of said display panel based on a result of measurement performed by said first measuring unit;

a specifying unit which controls said second measuring unit so as to measure the individual temperature values of said plurality of light emitting blocks in a predetermined period of time, obtains a result of the measurement by said second measuring unit in the predetermined period of time, and specifies a light emitting block of which the magnitude of a change in temperature within the predetermined period of time is smaller than a threshold value;

a setting unit which sets a patch image display area for displaying a patch image for calibration in a region of the display panel corresponding to the light emitting block specified by said specifying unit; and a generation unit which generates the patch image to be displayed in the patch image display area set by said setting unit;

wherein said calibration unit carries out the calibration based on the result of the measurement by said first measuring unit in a case where the patch image generated by said generation unit is displayed in the patch image display area set by said setting unit.

9. An image display device comprising:

a backlight having a plurality of light emitting blocks;

a display panel to display an image based on image data which is inputted thereto, by changing a transmissivity thereof for light irradiated from the backlight for each pixel in accordance with the inputted image data;

a plurality of second measuring units which measures individual temperature values at a plurality of positions in said backlight;

a setting unit which sets a patch image display area for displaying a patch image for calibration based on a result of measurement performed by said plurality of second measuring units;

a generation unit which generates the patch image to be displayed in the patch image display area set by said setting unit; and a calibration unit which carries out calibration of said display panel based on a result of measurement performed by a first measuring unit which measures the brightness and or chromaticity of said display panel in a case where the patch image generated by said generation unit is displayed in said display panel.

10. The image display apparatus as set forth in claim 9, wherein said setting unit sets, based on the result of measurement performed by said plurality of second measuring units, the patch image display area for displaying the patch image for calibration in a region of the display panel corresponding to a light emitting block of which the magnitude of a change in temperature within a predetermined period of time is smaller than a threshold value.

11. The image display apparatus as set forth in claim 9, wherein said setting unit sets, based on the result of measurement performed by said plurality of second measuring units, the patch image display area for displaying the patch image for calibration in a region of the display panel corresponding to a light emitting block of which a difference between a temperature thereof and a predetermined reference temperature is smaller than a threshold value.

12. The image display apparatus as set forth in claim 9, wherein said setting unit sets the patch image display area for displaying the patch image for calibration in a region which is included in an area which is predetermined to be measured by said first measuring unit.

13. The image display apparatus as set forth in claim 9, wherein said setting unit sets the patch image display area in a predetermined area close to a central portion of the display panel.

14. The image display apparatus as set forth in claim 9, wherein said generation unit adjusts the size of the patch image to be generated according to the size of the patch image display area set by said setting unit.

15. A control method for an image display device which includes a backlight having a plurality of light emitting blocks, and a display panel to display an image based on image data which is inputted thereto, by changing a transmissivity thereof for light irradiated from the backlight for each pixel in accordance with the inputted image data, said control method comprising:

obtaining individual temperature values at a plurality of positions in said backlight measured by a plurality of second measuring units;

setting a patch image display area for displaying a patch image for calibration based on said obtained measured temperature values;

generating the patch image to be displayed in said patch image display area set in said setting; and calibrating said display panel based on measured values of the brightness or chromaticity of said display panel measured by a first measuring unit in a case where the patch image generated in said generating is displayed in said display panel.

16. The control method for an image display device as set forth in claim 15, wherein in the setting, the patch image display area for displaying the patch image for calibration is set, based on said obtained measured temperature values, in a region of the display panel corresponding to a light emitting block of which the magnitude of a change in temperature within a predetermined period of time is smaller than a threshold value.

17. The control method for an image display device as set forth in claim 15, wherein in the setting, the patch image display area for displaying the patch image for calibration is set, based on said obtained measured temperature values, in a region of the display panel corresponding to a light emitting block of which a difference between a temperature thereof and a predetermined reference temperature is smaller than a threshold value.

18. The control method for an image display device as set forth in claim 15, wherein in said setting, the patch image display area for displaying the patch image for calibration is set in a region which is included in an area which is predetermined to be measured by said first measuring unit.

19. The control method for an image display device as set forth in claim 15, wherein in said setting, the patch image display area in a predetermined area close to a central portion of the display panel.

20. The control method for an image display device as set forth in claim 15, wherein in the generating, the size of the patch image to be generated is adjusted according to the size of the patch image display area set in said setting.

* * * * *